US009614291B2

(12) United States Patent
Hu et al.

(10) Patent No.: US 9,614,291 B2
(45) Date of Patent: Apr. 4, 2017

(54) TWO-DIMENSIONAL ANTENNA ARRAY, ONE-DIMENSIONAL ANTENNA ARRAY AND SINGLE DIFFERENTIAL FEEDING ANTENNA

(71) Applicant: U&U ENGINEERING INC., Taipei (TW)

(72) Inventors: Chun-Hao Hu, Taoyuan (TW); Chi-Ho Chang, New Taipei (TW); Yo-Sheng Lin, Taichung (TW); Ping-Chang Tsao, Taoyuan (TW)

(73) Assignee: U&U ENGINEERING INC., Taipei (TW)

( * ) Notice: Subject to any disclaimer, the term of this patent is extended or adjusted under 35 U.S.C. 154(b) by 0 days.

(21) Appl. No.: 14/845,960

(22) Filed: Sep. 4, 2015

(65) Prior Publication Data

US 2016/0204517 A1 Jul. 14, 2016

(30) Foreign Application Priority Data

Jan. 12, 2015 (TW) ..... 104100898 A

(51) Int. Cl.
*H01Q 21/00* (2006.01)
*H01Q 21/06* (2006.01)
*H01Q 9/04* (2006.01)

(52) U.S. Cl.
CPC ..... *H01Q 21/065* (2013.01); *H01Q 9/045* (2013.01); *H01Q 21/0075* (2013.01)

(58) Field of Classification Search
CPC ... H01Q 9/045; H01Q 21/0075; H01Q 21/065
See application file for complete search history.

(56) References Cited

U.S. PATENT DOCUMENTS 3,811,128 A * 5/1974 Munson ..... H01Q 9/0407 342/371
5,790,078 A * 8/1998 Suzuki ..... H01Q 1/247 29/600
7,982,681 B2 7/2011 Chang et al.

FOREIGN PATENT DOCUMENTS

TW I385857 B 2/2013

* cited by examiner

*Primary Examiner* — Hoang Nguyen
(74) *Attorney, Agent, or Firm* — patenttm.us

(57) ABSTRACT

A two-dimensional antenna array has n rows of 1×m one-dimensional array and each one-dimensional array is composed of multiple single differential feeding antennas. Each single differential feeding antenna has a differential feeding structure and a microstrip antenna stripe. A longitudinal length of the microstrip antenna stripe is no longer than one wavelength in a dielectric medium, so the microstrip antenna stripe is not excited to a high-order mode. An angle of inclination of a main beam aligns with the broadside and a width of the main beam is further concentrated at elevation direction. The differential feeding structure can reduce an even mode to enhance an isolation. The one and two-dimensional antenna array is miniature by using the small single differential feeding antennas. Isolation and gain of a dual-antenna system using the two-dimensional or one-dimensional antenna arrays are further enhanced and increased if more feeding antenna arrays are used.

20 Claims, 8 Drawing Sheets

TWO-DIMENSIONAL ANTENNA ARRAY, ONE-DIMENSIONAL ANTENNA ARRAY AND SINGLE DIFFERENTIAL FEEDING ANTENNA

CROSS-REFERENCE TO RELATED APPLICATIONS

This application is based upon and claims priority under 35 U.S.C. 119 from Taiwan Patent Application No. 104100898 filed on Jan. 12, 2015, which is hereby specifically incorporated herein by this reference thereto.

BACKGROUND OF THE INVENTION

1. Field of the Invention

The present invention is related to an antenna array of a dual-antenna system, and more particularly to a two-dimensional antenna array and one-dimensional antenna array of a dual-antenna system having a high isolation.

2. Description of the Prior Arts

Generally, a radar transceiver has a receiving port and a transmitting port to respectively receive and transmit the radio signal. The radio signal can be transmitted to a farther way if an intensity of the radio signal is enhanced at the transmitting port. However, the radio signal at the receiving port is interfered by coupling with the radio signal with enhanced radio signal at the transmitting port. Accordingly, the radio signal of an entire middle frequency may easily enter a saturated state and a detection signal of a remote target is sunk in a noise signal. Alternatively, an intensity of local-port signal of the middle frequency may vary widely (e.g. a DC offset in a time domain response varied widely) and a quantization distortion is occurred when a digital signal processing unit processes the weaker detection signal of the remote target. Therefore, isolation means are respectively employed at an antenna port and a circuit of the radar transceiver to reduce a coupling interference between the receiving and transmitting ports.

There are two types of the isolation means. The first one is providing a single antenna with a circulator used in a conventional a radar system of a frequency modulated continuous wave. The second one is providing a dual-antenna structure. In the first type of the isolation mean, a largest isolation between transmitting and receiving ports is about −35 dB and an amplifier is not allowed to connect between the antenna and the circulator. In addition, an impedance of the antenna does not match that of the circulator, so that a reflection coefficient ($S_{11}$) of the signal antenna is increased to result in a more signal leakage. Therefore, the isolation mean of the first type is not the best one and has other design limitation. With reference to FIG. 9, the dual-antenna structure 50 has a transmitting antenna 51 and a receiving antenna 52. Each of the transmitting antenna 51 and the receiving antenna 52 is a 4×1 one-dimensional antenna array 511, 521 consisting of four parallel single-stripe differential antenna units. A simple way to enhance the isolation between the receiving and transmitting ports is to increase a distance Dm between the receiving and transmitting ports. However, larger space is also required accordingly. Other types of the dual-antenna structure are further described as follows.

1. One type of the dual-antenna structure is a Branch Line Coupler: The branch line coupler exchanges a coupled factor and the reflection coefficient to have a high isolation and further uses a matching network to achieve a high isolation requirement.

2. An inductance element is added between the receiving and transmitting antennas of the dual-antenna structure, and an elongated slot or a T-shaped slot is formed on a grounding plane of the dual-antenna structure. The inductance element can be formed by adding metal plates or is a parasitic inductance. The modified dual-antenna structure provides a high isolation. However, a hole needs to be defined on the grounding plane to form the elongated slot or the T-shaped slot or a conductive via needs to be formed, and an antenna single end of a metal strip formed on an opposite plane also needs to be electrically connected to the grounding plane. A manufacturing procedure is more complex and the product uniformity is hardly controlled accordingly.

3. A slot is formed on a common grounding plane of the receiving and transmitting antennas so that a coupling current is restrained by a band-notched characterization and the isolation between the receiving and transmitting antennas is enhanced. However, this modified dual-antenna structure has drawbacks of forming the slot which are the same as the second modified dual-antenna structure mentioned above.

4. One type of the dual-antenna structure is a Dual Polarized Dielectric Resonator Antenna having two orthogonal polarized antennas and a T-shaped slot. The T-shaped slot reduces excitation mode coupling between two orthogonal polarized antennas to enhance the isolation of the two orthogonal polarized antennas. However, an accuracy of polarizing antenna is not easy and the isolation is not easily controlled. In addition, forming the T-shaped slot has the same drawback of the third type.

5. One type of the dual-antenna structure is a Leaky-Wave Dual Antenna System disclosed by TW invention patent No. I385857. With reference to FIG. 10, the leaky-wave dual-antenna system 60 has a transmitting antenna 61 and a receiving antenna 62. Each of the transmitting and receiving antennas 61 and 62 is composed of one-dimensional differential leaky-wave antenna array. To implement a differential feature, a signal phase difference between two feeding points of each of the transmitting and receiving antennas 61 has a 180 degree. A longitudinal length (L) of each of the transmitting and receiving antennas 61 and 62 is equal or greater than three times of a wavelength in a dielectric medium, so the leaky-wave dual-antenna system 60 can be excited to a high order mode and operates at high gain. Thus, the isolation of the leaky-wave dual-antenna system 60 is measured when the transmitting and receiving antennas are arranged in parallel and the isolation in a goal frequency range achieves −45 dB or more than that. The measured isolation of the leaky-wave dual-antenna system 60 is greater than that of the single antenna with the circulator. However, each of the transmitting antenna 61 or the receiving antenna 62 of the leaky-wave dual-antenna system 60 is not further designed as a two-dimensional antenna array since the longitudinal length thereof is equal or greater than three times of the wavelength in the dielectric medium and the one-dimensional antenna array has many design limitations. For example, a beam is only concentrated and shrunk at an azimuth direction based on a field pattern of the one-dimensional antenna array but the beam cannot be concentrated and shrunk at an elevation direction. Furthermore, a radiation angle at broadside of the leaky-wave dual-antenna system 60 is shifted 90 degrees when the leaky-wave dual-antenna system 60 operates at a high order mode. The applications of the leaky-wave dual-antenna system 60 are limited accordingly.

To overcome the shortcomings, the present invention provides a two-dimensional antenna array and one-dimensional antenna array of a dual-antenna system to mitigate or obviate the aforementioned problems.

SUMMARY OF THE INVENTION

The objective of the present invention provides a two-dimensional antenna array, an one-dimensional antenna array and a single differential feeding antenna. A dual-antenna system may be consisted of the two two-dimensional antenna arrays and may be consisted of the two one-dimensional antenna arrays. The dual-antenna system has a high isolation accordingly.

To achieve the objective, the two-dimensional antenna array has a dielectric substrate, multiple antenna units arranged to n rows and m columns, n power dividing circuits respectively connected to the adjacent row of the antenna units, a main feeding point connected to the n power dividing circuits, and a grounding layer; wherein each of the antenna unit has multiple parallel non-high-order-mode differential feeding antennas and a power divider. The power divider is connected among the non-high-order-mode differential feeding antennas and the corresponding power dividing circuit. Each of the non-high-order-mode differential feeding antennas has a differential feeding structure and a microstrip antenna stripe. The differential feeding structure has two ports. One port is a feeding point, and the other port is connected to a differential circuit having an inverting input and a non-inverting input. The microstrip antenna stripe has two feeding terminals respectively connected to the inverting input and the non-inverting input of the differential circuit, and a longitudinal length which is no longer than one wavelength in a dielectric medium.

The two-dimensional antenna array of the dual-antenna system includes multiple parallel non-high-order-mode differential feeding antennas, so that a coupling therebetween of the dual-antenna system is decreased and an isolation of the dual-antenna system is enhanced. Furthermore, since the longitudinal length of the microstrip antenna stripe is no longer than one wavelength in a dielectric medium, the two-dimensional antenna array can be formed in a limited space to increase entire gain, a beam width is concentrated at the elevation direction, and the microstrip antenna stripe is not excited to a high-order mode. Therefore, an angle of inclination of the main beam aligns with the broadside of the non-high-order-mode differential feeding antenna and is perpendicular to a plan of the non-high-order-mode differential feeding antenna. Therefore, the dual-antenna system using two-dimensional antenna arrays in accordance with the present invention has a high isolation.

To achieve another objective, the one-dimensional antenna array of the dual-antenna system has a dielectric substrate, multiple antenna units arranged to one row, a power dividing circuit connected to the row of the antenna units, a main feeding point connected to the power dividing circuit, and a grounding layer. Each of the antenna unit has multiple parallel non-high-order-mode differential feeding antennas and a power divider. The power divider is connected among the non-high-order-mode differential feeding antennas and the corresponding power dividing circuit. Each of the non-high-order-mode differential feeding antenna has a differential feeding structure and a microstrip antenna stripe. The differential feeding structure has two ports. One port is a feeding point, and the other port is connected to a differential circuit having an inverting input and a non-inverting input. The microstrip antenna stripe has two feeding terminals respectively connected to the inverting input and the non-inverting input of the differential circuit, and a longitudinal length which is no longer than one wavelength in a dielectric medium.

The one-dimensional antenna array of the dual-antenna system includes multiple parallel non-high-order-mode differential feeding antennas, so an isolation of the dual-antenna system is enhanced. Furthermore, since the longitudinal length of the microstrip antenna stripe is no longer than one wavelength in a dielectric medium, the one-dimensional antenna array is smaller than the conventional one-dimensional differential leaky-wave antenna array and a beam width is further concentrated at the elevation direction. Since the longitudinal length of the microstrip antenna stripe is no longer than the one wavelength in the dielectric medium, the microstrip antenna stripe is not excited to a high-order mode. Therefore, an angle of inclination of the main beam aligns with the broadside of the non-high-order-mode differential feeding antenna and is perpendicular to a plan of the non-high-order-mode differential feeding antenna.

To achieve another objective, the single differential feeding antenna has a differential feeding structure and a microstrip antenna stripe. The differential feeding structure has two ports. One port is a feeding point, and the other port is connected to a differential circuit having an inverting input and a non-inverting input. The microstrip antenna stripe has two feeding terminals respectively connected to the inverting input and the non-inverting input of the differential circuit, and a longitudinal length which is no longer than one wavelength in a dielectric medium.

Since the longitudinal length of the microstrip antenna stripe is no longer than the one wavelength in the dielectric medium, a beam width is further concentrated at the elevation direction and the microstrip antenna stripe is not excited to a high-order mode. Therefore, an angle of inclination of the main beam aligns with the broadside of the single differential feeding antenna and is perpendicular to a plan of the single differential feeding antenna.

Other objectives, advantages and novel features of the invention will become more apparent from the following detailed description when taken in conjunction with the accompanying drawings.

DETAILED DESCRIPTION OF THE PREFERRED EMBODIMENTS

The present invention provides a two-dimensional antenna array of a dual-antenna system having high isolation and two-dimensional narrow beam, an one-dimensional antenna array of the dual-antenna system and a single differential feeding antenna. Multiple embodiments are further described as follow.

Figure 1:
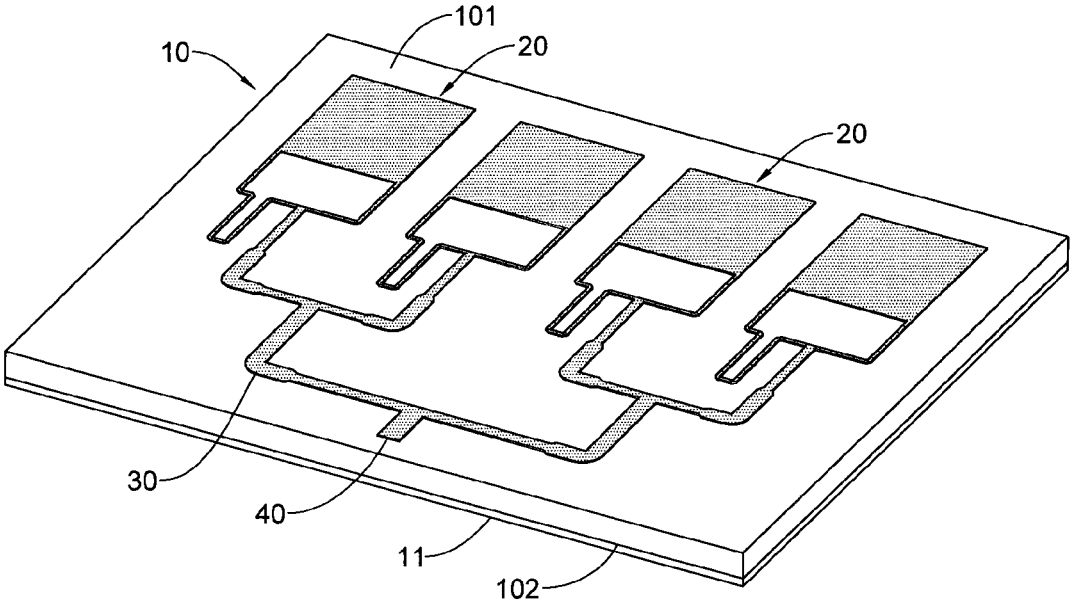
FIG. 1 is a perspective view of an one-dimensional antenna array in accordance with the present invention.
Figure 2:
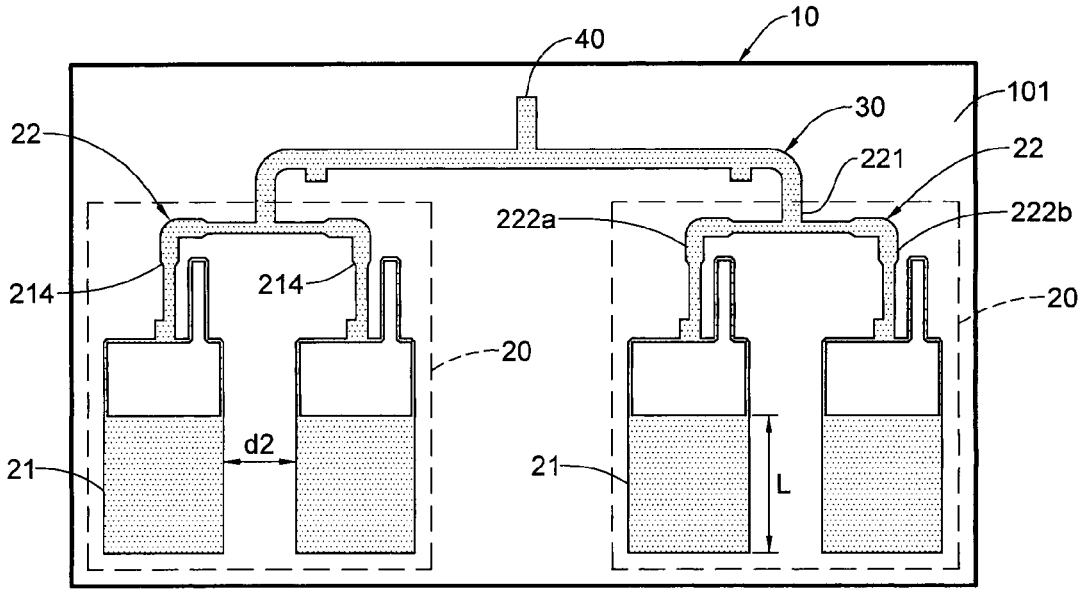
FIG. 2 is a top plan view of FIG. 1.

The dual-antenna system has a transmitting antenna and a receiving antenna. Each of the transmitting and receiving antennas may be the one-dimensional antenna array or the two-dimensional antenna. With reference to FIGS. 1 and 2, a first preferred embodiment of the present invention discloses 1×2 one-dimensional antenna array. The one-dimensional antenna array has a dielectric substrate 10, m antenna units 20 arranged to one row (m=2), a power dividing circuit 30, a main feeding point 40 and a grounding layer 11. The power dividing circuit 30 is connected to the two antenna units 20 and the main feeding point 40 is connected to the power dividing circuit 30.

The dielectric substrate 10 has two opposite planes 101, 102. The antenna units 20, the power dividing circuit 30 and the main feeding point 40 are formed on the plane 101. The grounding layer 11 is formed on the other plane 102.

Each of the antenna units 20 has k non-high-order-mode differential feeding antennas 21 and a one to k power divider 22. In the preferred embodiment, k=2 and each of the antenna units 20 has two parallel non-high-order-mode differential feeding antennas 21 and an one-to-two power divider 22 connected to two feeding points 214 of the two parallel non-high-order-mode differential feeding antennas 21. The one-to-two power divider 22 has a feeding circuit 221, a first impedance match circuit 222*a* with a first longitudinal length of a quarter of the wavelength in the dielectric medium and a second impedance match circuit 222*b* with a second longitudinal length of a quarter of the wavelength in the dielectric medium. The feeding circuit 221 of the one-to-two power divider 22 is connected to the power dividing circuit 30.

Figure 3:
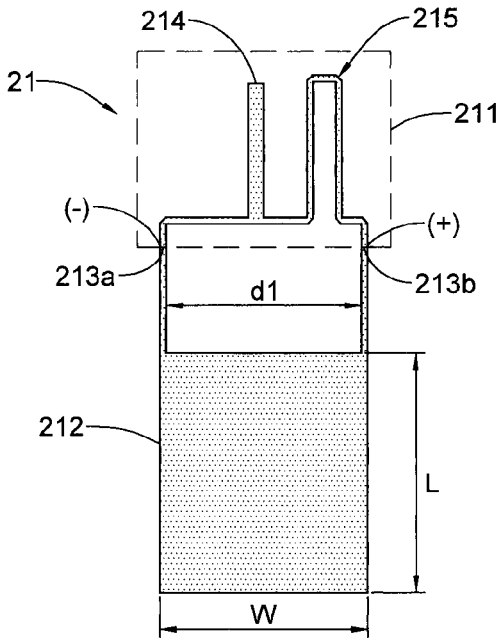
FIG. 3 is a plan view of an antenna pattern of a non-high-order-mode differential feeding antenna.

With further reference to FIG. 3, each of the non-high-order-mode differential feeding antennas 21 has a differential feeding structure 211 and a microstrip antenna stripe 212. The differential feeding structure 211 has two ports. One port is the feeding point 214 and the other port is connected to a differential circuit 215. The differential circuit 215 has an inverting input (−) and a non-inverting input (+) respectively connected to two feeding terminals 213*a*, 213*b* of the microstrip antenna stripe 212. A signal phase difference between the two feeding terminals 213*a*, 213*b* is 180 degree. A longitudinal length L of the microstrip antenna stripe 212 is no longer than the one wavelength in the dielectric medium $\lambda_g$ ($L \leq \lambda_g$). Since the wavelength in the dielectric medium is determined by an operating frequency band, the wavelength in the dielectric medium is calculated by an equation $\lambda_g = \lambda_0/\sqrt{\epsilon_g}$, wherein $\lambda_0$ is the wavelength of electromagnetic wave in vacuum ands, is a dielectric constant. In addition, a gap d1 between the two feeding terminals (−) and (+) of the microstrip antenna stripe 212 is approximately equal to a half of the wavelength in the dielectric medium ($d1 \cong \lambda_g/2$). A widthwise length W of the microstrip antenna stripe 212 is a half of the wavelength in the dielectric medium ($w = \lambda_g/2$). A gap d2 between the two adjacent microstrip antenna bodies 212 is a half of the wavelength in the dielectric medium ($d2 \cong \lambda_g/2$).

Figure 4A:
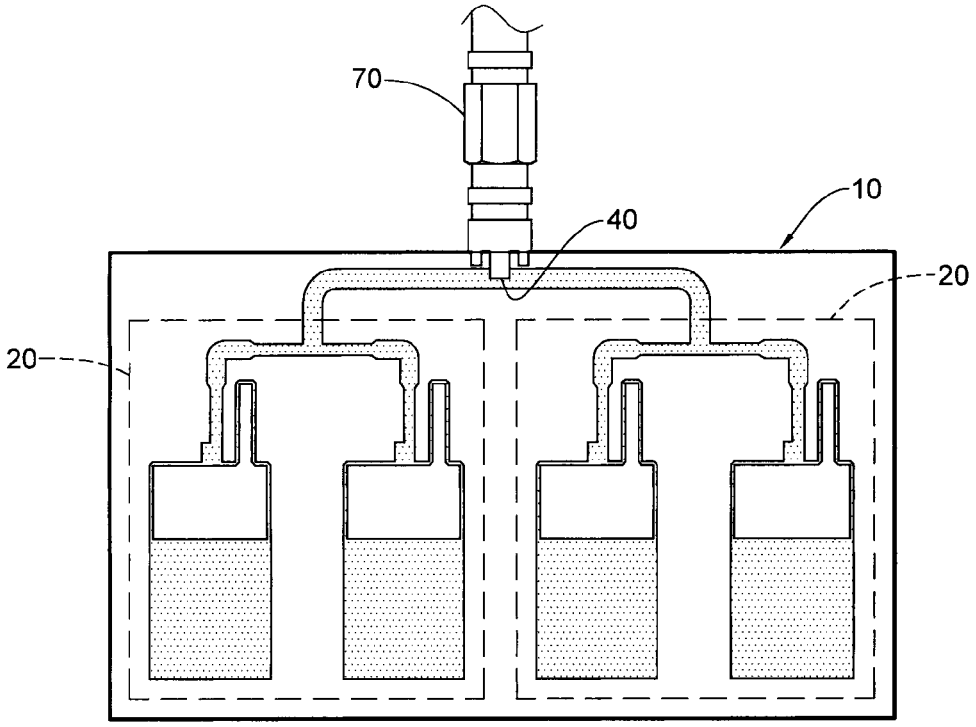
FIG. 4A is a plan view of the one-dimensional antenna array in FIG. 1 connected to a coaxial cable.
Figure 4B:
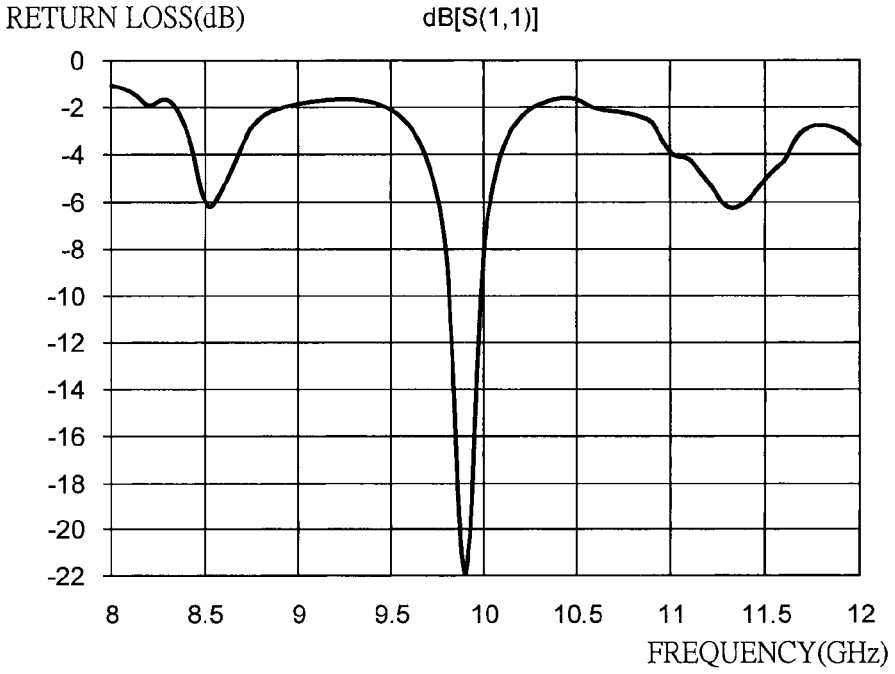
FIG. 4B is a S11 parameter diagram measured at 9.9 GHz frequency.

Furthermore, to enhance the gain of the each of the non-high-order-mode differential feeding antennas 21, an impedance of each of the two feeding terminals 213*a*, 213*b* of the microstrip antenna stripe 212 is 100 ohm, an impedance of the feeding point 214 of the differential feeding structure is 50 ohm, an impedance of each of the inverting and non-inverting inputs (−) and (+) of each differential circuit 215 is 100 ohm, an impedance of each feeding circuit 221 of the power divider 22 is 50 ohm and a loading impedance of each of the first and second impedance match circuits 222*a*, 222*b* is 70.7 ohm. Accordingly, a reflection coefficient S11 of a goal frequency band is improved widely. With reference to FIG. 4A, the main feeding point 40 of the one-dimensional antenna array of FIG. 1 is connected to a coaxial cable 70 to measure the reflection coefficient S11 at the measurement frequency 9.9 GHz. In FIG. 4B, the measured reflection coefficient is −21.83 dB so the reflection coefficient of the one-dimensional antenna array is improved and the gain of each non-high-order-mode differential feeding antenna 21 is enhanced accordingly.

Figure 5A:
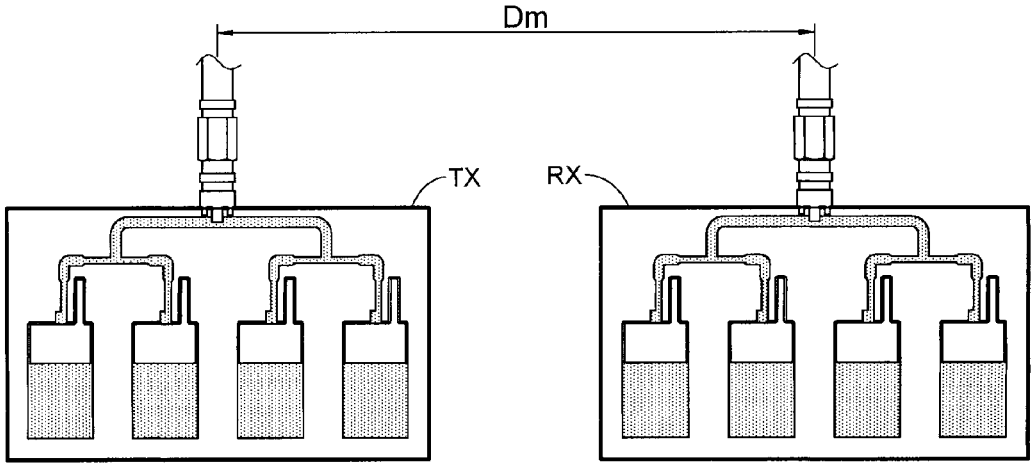
FIG. 5A is a plan view of a dual-antenna structure having two one-dimensional antenna arrays of FIG. 1 in a first arrangement type.

Each non-high-order-mode differential feeding antenna 21 uses the differential feeding structure 211 to reduce the even mode coupling between the microstrip antenna stripe 212 and a circuit connected to the microstrip antenna stripe 212. In comparison with the conventional dual-antenna system using the one-dimensional antenna arrays with a single feeding point, the dual-antenna system using the non-high-order-mode differential feeding antennas 21 has a higher isolation and does not require an extra accurate hole drilling procedure. Since the gap d2 between the two adjacent microstrip antenna bodies 212 is shorten, the isolation is relatively enhanced. With reference to FIG. 5A, two one-dimensional antenna arrays are respectively used as the transmitting antenna TX and the receiving antenna RX and of the dual-antenna system and the transmitting and receiving antennas TX, RX are arranged in a first arrangement type. In the first arrangement type, the receiving antenna RX and the transmitting antenna TX are arranged in parallel and two opposite long sides of each of the receiving and transmitting antennas RX, TX are parallel with the a horizontal direction. When a first distance Dm between the main feeding points of the transmitting and receiving antennas TX, RX are adjusted in four different distances, four isolation are respectively measured under the measurement frequency 9.9 GHz and shown in Table One.

TABLE ONE

| | Dm(cm) | 7 | 9 | 11 | 13 |
|---|---|---|---|---|---|
| Antenna | Isolation(dB) | −48 | −56 | −62 | −64 |

Figure 5B:
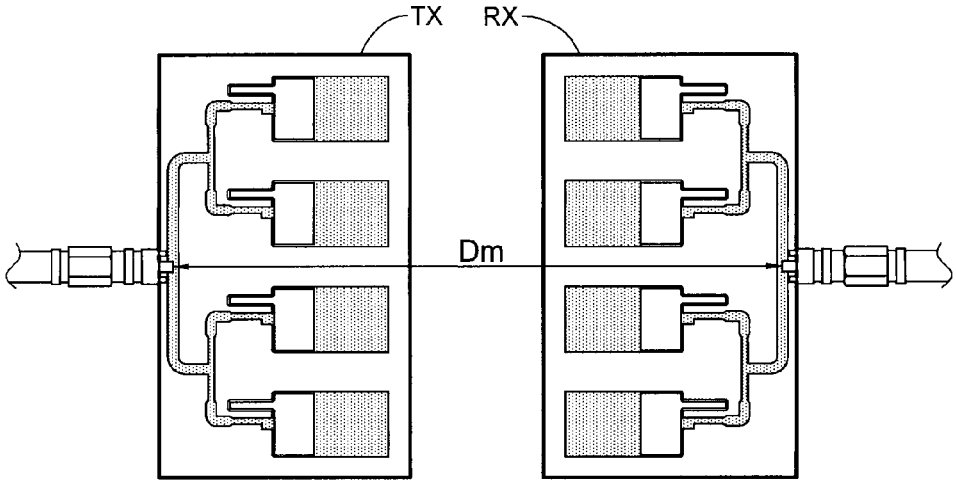
FIG. 5B is a plan view of a dual-antenna structure having two one-dimensional antenna arrays of FIG. 1 in a second arrangement type.
Figure 6A:
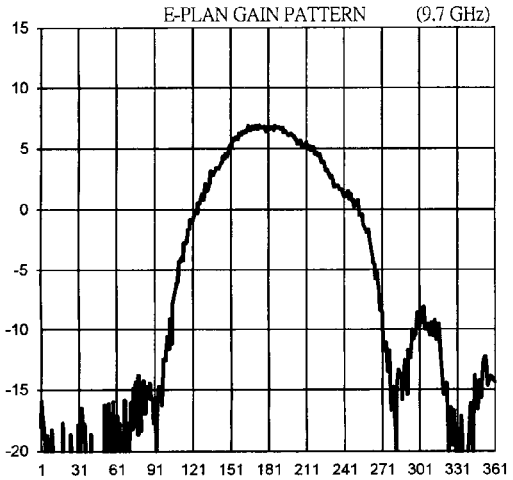
FIGS. 6A to 6E are E-plan gain patterns of the one-dimensional the antenna array of FIG. 1 respectively measured at 9.7 GHz, 9.8 GHz, 9.9 GHz, 10 GHz and 10.1 GHz frequency.
Figure 6B:
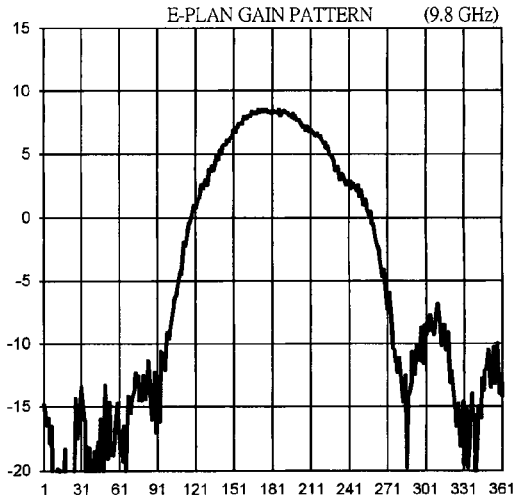
Figure 6C:
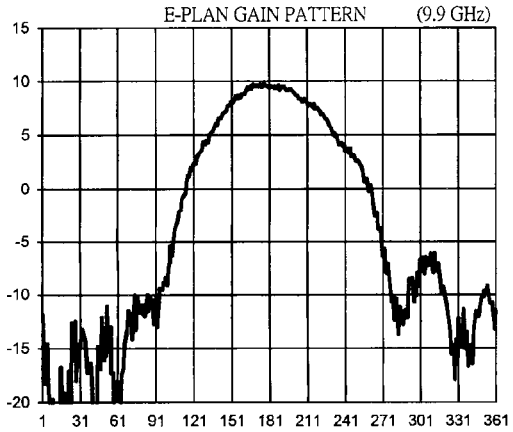
Figure 6D:
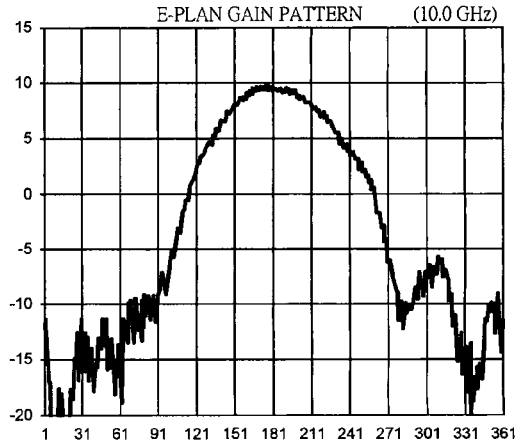
Figure 6E:
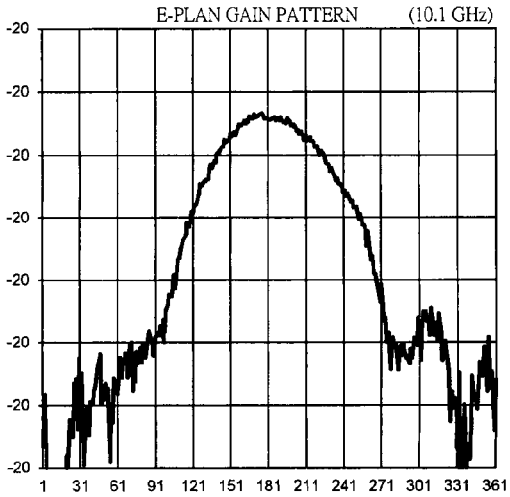
Figure 7A:
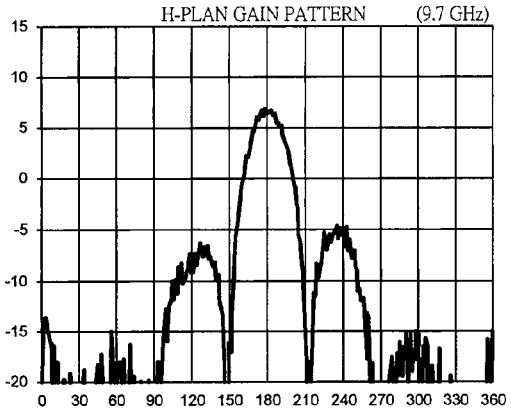
FIG. 7A to 7E are H-plan gain patterns of the one-dimensional the antenna array of FIG. 1 respectively measured at 9.7 GHz, 9.8 GHz, 9.9 GHz, 10 GHz and 10.1 GHz frequency.
Figure 7B:
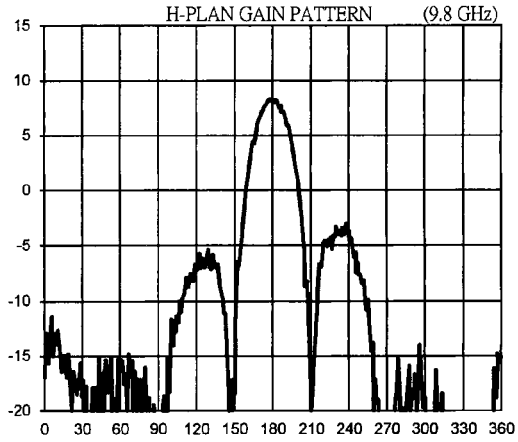
Figure 7C:
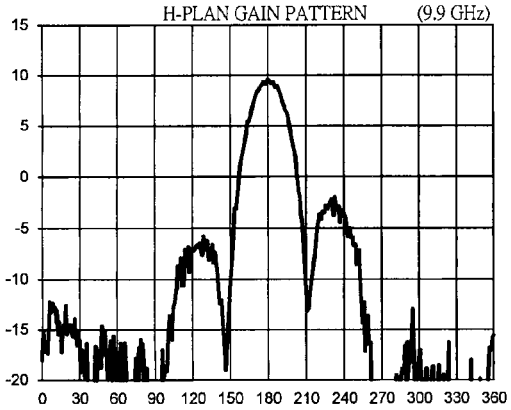
Figure 7D:
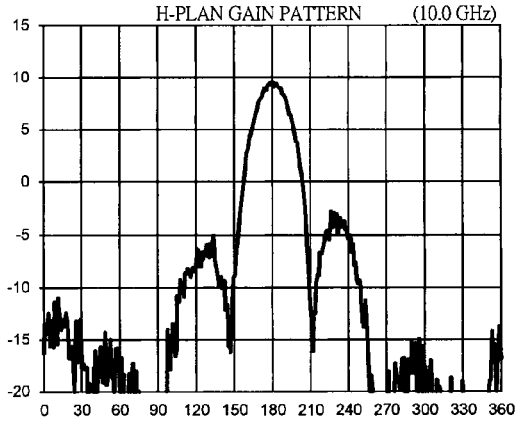
Figure 7E:
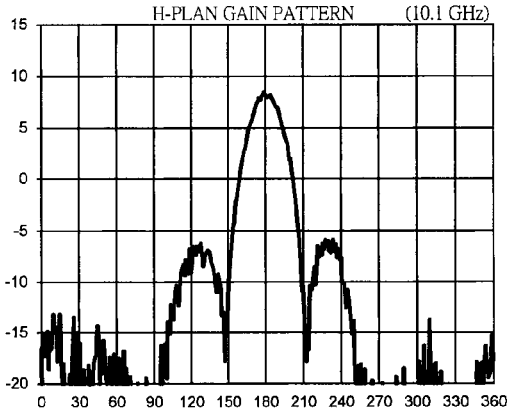

With reference to FIG. 5B, the transmitting antenna TX and the receiving antenna RX are arranged in a second arrangement type. In the second arrangement type, the receiving antenna RX and the transmitting antenna TX are arranged in parallel and two opposite short sides of each of the receiving and transmitting antennas RX, TX are parallel with the horizontal direction. When a second distance Dm between the main feeding points of the transmitting and receiving antennas TX, RX are adjusted in four different distances, four isolation are respectively measured under the measurement frequency 9.9 GHz and shown in Table Two. Accordingly, the isolation of the dual-antenna system using the non-high-order-mode differential feeding antennas 21 is less 10 dB than that of the conventional dual-antenna system using the one-dimensional antenna arrays with the single feeding point in the second arrangement type. Therefore, the isolation of the dual-antenna system using the non-high-order-mode differential feeding antennas 21 in accordance with the present invention is better.

TABLE TWO

| | Dm (cm) | | | | | |
|---|---|---|---|---|---|---|
| | 8 | 10 | 12 | 14 | 16 | 20 |
| Antenna Isolation (dB) | −30 | −34 | −37 | −40 | −42 | −47 |

Furthermore, a radiation beam width in E-plan is determined by the number of the non-high-order-mode differential feeding antenna 21, so the radiation beam of the dual-antenna system is concentrated at the azimuth direction to increase an directivity of the azimuth direction. With reference to FIGS. 6A to 6E, five E-plan gain patterns of the one-dimensional the antenna array of FIG. 1 are respectively measured at frequencies 9.7 GHz, 9.8 GHz, 9.9 GHz, 10 GHz and 10.1 GHz, and these gains are the best at those frequencies. A radiation beam width in H-plan is determined by a longitudinal length of a microstrip antenna stripe 212, so the radiation beam of the dual-antenna structure is concentrated and shrunk at Elevation direction to increase an directivity of the Elevation direction. With reference to FIGS. 7A to 7E, five H-plan gain patterns of one-dimensional the antenna array of FIG. 1 are respectively measured at frequencies 9.7 GHz, 9.8 GHz, 9.9 GHz, 10 GHz and 10.1 GHz, and these gains are the best at those frequencies. In addition, the longitudinal length of the microstrip antenna stripe 212 of the non-high-order-mode differential feeding antenna 21 is no longer than the one wavelength in the dielectric medium, so each non-high-order-mode differential feeding antenna 21 is not excited to the high order mode. Therefore, an angle of inclination of the main beam aligns with the broadside of the non-high-order-mode differential feeding antenna 21 and is perpendicular to a plan of the non-high-order-mode differential feeding antenna 21.

Figure 8:
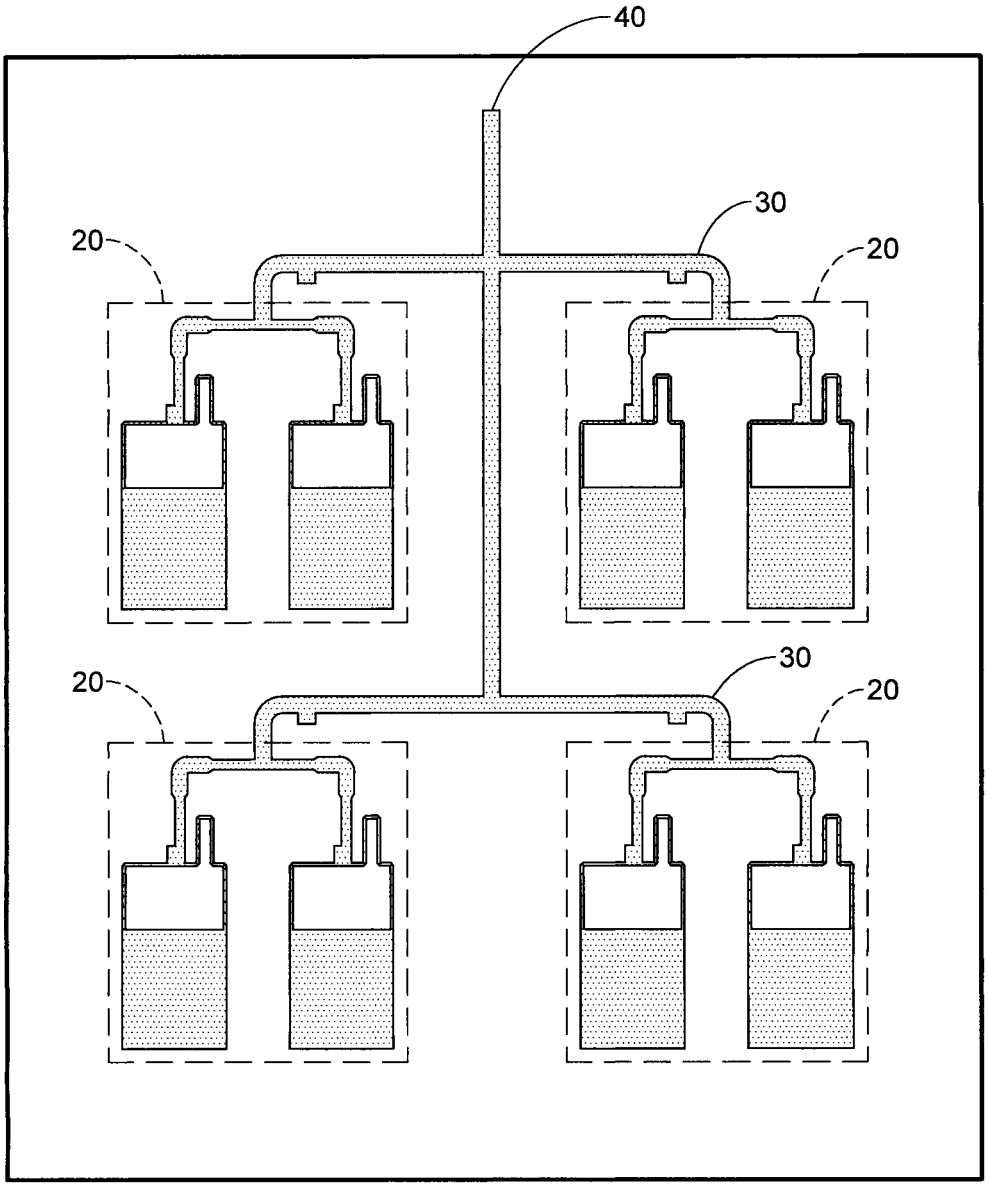
FIG. 8 is a plan view of a two-dimensional antenna array in accordance with the present invention.
Figure 9:
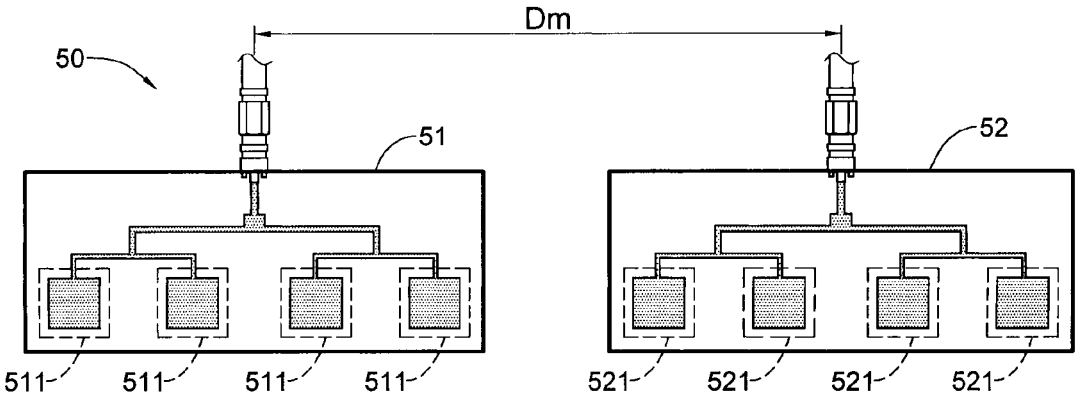
FIG.9 (PRIOR ART)
FIG. 9 is a plan view of a conventional dual-antenna structure having a transmitting antenna and a receiving antenna in the first arrangement type.
Figure 10:
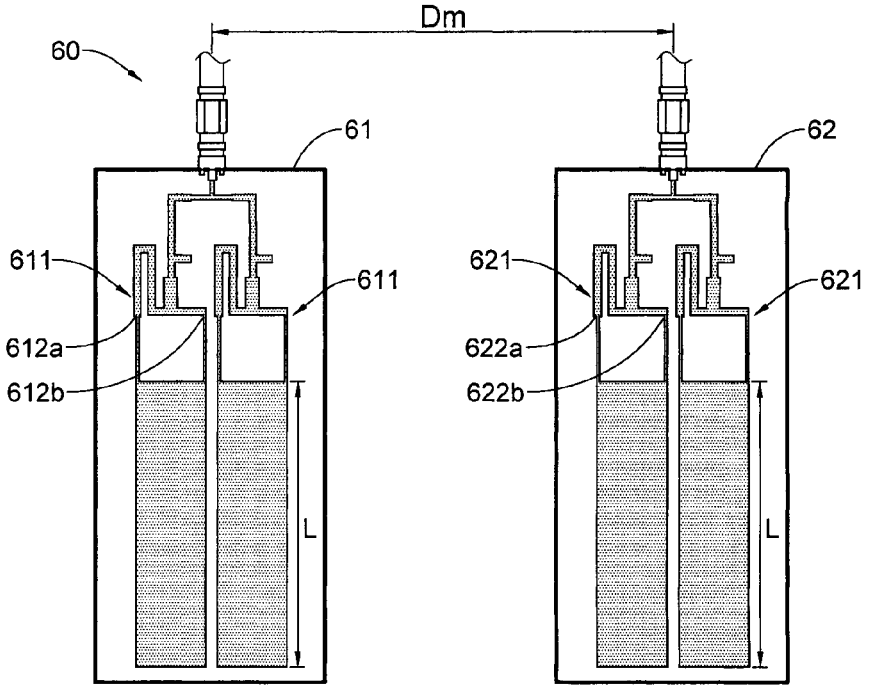
FIG.10 (PRIOR ART)
FIG. 10 is a plan view of a Leaky-Wave Dual Antenna System disclosed by TW I385857 B invention patent.

In comparison with the leaky-wave antenna with triple wavelength in the dielectric medium, the non-high-order-mode differential feeding antennas 21 can further constitute a two-dimensional antenna array in a limited space since the longitudinal length of the non-high-order-mode differential feeding antenna 21 is shorter than the one wavelength in the dielectric medium. With further reference to FIG. 8, a 2×2 two-dimensional antenna array is shown and has a dielectric substrate 10, n×m antenna units 20, n power diving circuits 30, a main feeding point 40 and a grounding layer 11. In the preferred embodiment, n=2 and m=2 so that the two-dimensional antenna array has four antenna units 20.

The antenna units 20, the power dividing circuits 30 and the main feeding point 40 are formed on the plane of the dielectric substrate 10 and the grounding layer is formed on the other plane of the dielectric substrate 10. The n×m antenna units 20 are arranged to n rows and m columns. The n power diving circuits 30 are respectively formed adjacent to the n row of the antenna units 20. Each of the n power dividing circuit 30 is connected to the adjacent row of the antenna units 20. A feeding point of each power dividing circuit 30 is connected to the main feeding point 40. Each of the antenna units 20 is the same as the antenna unit 20, the details of the antenna unit 20 is not described again. The feeding circuit 221 of the power divider 22 of the antenna unit 20 is connected to the power dividing circuit 30 on the corresponding row.

Based on the foregoing description, the present invention has advantages as follow.

1. In comparison with the conventional dual-antenna system with high isolation, the dual-antenna system using the one-dimensional antennas or the two-dimensional antenna of the present invention has the higher isolation has higher stability and low manufacturing cost since the dielectric substrate may be a printed circuit board (PCB) board.

2. The present invention has good and high isolation since the isolation of the dual-antenna system using the one-dimensional antennas of the present invention is less 10 dB than that of the conventional dual-antenna system using the 4×1 one-dimensional antenna arrays with the single feeding point.

3. In comparison with the conventional leaky-wave antenna array having characterizations which are similar to these of the present invention, the main beam of each of one-dimensional antenna array and two-dimensional antenna array of the present invention in the Elevation direction or the H-plan aligns with the broadside of the non-high-order-mode differential feeding antenna 21 and is perpendicular to a plan of the non-high-order-mode differential feeding antenna 21.

4. In comparison with the conventional leaky-wave antenna array having characterizations which are similar to these of the present invention, the two-dimensional antenna array, such as 2×2, 4×4 etc., can be formed to a miniature size. The present invention improves a problem of a wide angle on the Elevation direction and provides high isolation of the dual-antenna system using the two-dimensional antenna arrays.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An two-dimensional antenna array, comprising:

a dielectric substrate having a first plane and a second plane;

multiple antenna units formed on the first plane and arranged to n rows and m columns;

n power dividing circuits formed on the first plane, arranged to adjacent the n rows of the antenna units, and respectively connected to the adjacent row of the antenna units;

a main feeding point connected to the n power dividing circuits; and a grounding layer formed on the second plane; wherein each of the antenna unit comprises:

multiple parallel non-high-order-mode differential feeding antennas, each of which has:

a differential feeding structure having two ports, wherein one port is a feeding point and the other port is connected to a differential circuit having an inverting input and a non-inverting input; and a microstrip antenna stripe having:

two feeding terminals respectively connected to the inverting input and the non-inverting input of the differential circuit; and a longitudinal length which is no longer than one wavelength in a dielectric medium; and a power divider connected among the non-high-order-mode differential feeding antennas and the corresponding power dividing circuit.

2. The two-dimensional antenna array as claimed in claim 1, wherein a widthwise length of the microstrip antenna stripe is substantially equal to a half of the one wavelength in the dielectric medium and a gap between the two feeding terminals of the microstrip antenna stripe is substantially equal to a half of the one wavelength in the dielectric medium.

3. The two-dimensional antenna array as claimed in claim 2, wherein a gap between the two adjacent microstrip antenna bodies is substantially equal to a half of the one wavelength in the dielectric medium.

4. The two-dimensional antenna array as claimed in claim 3, wherein, an impedance of each of the two feeding terminals is 100 ohm;

an impedance of the feeding point of the differential feeding structure is 50 ohm;

an impedance of each of the inverting and non-inverting inputs is 100 ohm; and the power divider is a one-to-two power divider and has:

a feeding circuit having a 50 ohm loading impedance;

a first impedance match circuit having a first longitudinal length of a quarter of the one wavelength in the dielectric medium and a 70.7 ohm loading impedance; and a second impedance match circuit having a second longitudinal length of a quarter of the one wavelength in the dielectric medium and a 70.7 ohm loading impedance.

5. The two-dimensional antenna array as claimed in claim 4, wherein the one wavelength in the dielectric medium is calculated by an equation $\lambda_g=\lambda_0/\sqrt{\in_g}$, wherein $\lambda_0$ is the wavelength of electromagnetic wave in vacuum and $\in_g$ is a dielectric constant.

6. The two-dimensional antenna array as claimed in claim 1, wherein a gap between the two adjacent microstrip antenna bodies is substantially equal to a half of the wavelength in the dielectric medium.

7. The two-dimensional antenna array as claimed in claim 6, wherein, an impedance of each of the two feeding terminals is 100 ohm;

an impedance of the feeding point of the differential feeding structure is 50 ohm;

an impedance of each of the inverting and non-inverting inputs is 100 ohm; and the power divider is a one-to-two power divider and has:

a feeding circuit having a 50 ohm loading impedance;

a first impedance match circuit having a first longitudinal length of a quarter of the one wavelength in the dielectric medium and a 70.7 ohm loading impedance; and a second impedance match circuit having a second longitudinal length of a quarter of the one wavelength in the dielectric medium and a 70.7 ohm loading impedance.

8. The two-dimensional antenna array as claimed in claim 7, wherein the one wavelength in the dielectric medium is calculated by an equation $\lambda_g=\lambda_0/\sqrt{\in_g}$, wherein $\lambda_0$ is the wavelength of electromagnetic wave in vacuum and $\in_g$ is a dielectric constant.

9. An one-dimensional antenna array, comprising:

a dielectric substrate having a first plane and a second plane;

multiple antenna units formed on the first plane and arranged to one row;

a power dividing circuit formed on the first plane and connected to the row of the antenna units;

a main feeding point connected to the power dividing circuit; and a grounding layer formed on the second plane; wherein each of the antenna unit comprises:

multiple parallel non-high-order-mode differential feeding antennas, each of which has:

a differential feeding structure having two ports, wherein One port is a feeding point and the other port is connected to a differential circuit having an inverting input and a non-inverting input; and a microstrip antenna stripe having:

two feeding terminals respectively connected to the inverting input and the non-inverting input of the differential circuit; and a longitudinal length which is no longer than a one wavelength in a dielectric medium; and a power divider connected among the non-high-order-mode differential feeding antennas and the corresponding power dividing circuit.

10. The one-dimensional antenna array as claimed in claim 9, wherein a widthwise length of the microstrip antenna stripe is substantially equal to a half of the one wavelength in the dielectric medium and a gap between the two feeding terminals of the microstrip antenna stripe is substantially equal to a half of the one wavelength in the dielectric medium.

11. The one-dimensional antenna array as claimed in claim 10, wherein a gap between the two adjacent microstrip antenna bodies is substantially equal to a half of the one wavelength in the dielectric medium.

12. The one-dimensional antenna array as claimed in claim 11, wherein, an impedance of each of the two feeding terminals is 100 ohm;

an impedance of the feeding point of the differential feeding structure is 50 ohm;

an impedance of each of the inverting and non-inverting inputs is 100 ohm; and the power divider is a one-to-two power divider and has:

a feeding circuit having a 50 ohm loading impedance;

a first impedance match circuit having a first longitudinal length of a quarter of the one wavelength in the dielectric medium and a 70.7 ohm loading impedance; and a second impedance match circuit having a second longitudinal length of a quarter of the one wavelength in the dielectric medium and a 70.7 ohm loading impedance.

13. The one-dimensional antenna array as claimed in claim 12, wherein the one wavelength in the dielectric medium is calculated by an equation $\lambda_g=\lambda_0/\sqrt{\in_g}$, wherein $\lambda_0$ is the wavelength of electromagnetic wave in vacuum and $\in_g$ is a dielectric constant.

14. The one-dimensional antenna array as claimed in claim 9, wherein a gap between the two adjacent microstrip antenna bodies is substantially equal to a half of the one wavelength in the dielectric medium.

15. The one-dimensional antenna array as claimed in claim 14, wherein, an impedance of each of the two feeding terminals is 100 ohm;

an impedance of the feeding point of the differential feeding structure is 50 ohm;

an impedance of each of the inverting and non-inverting inputs is 100 ohm; and the power divider is a one-to-two power divider and has:

a feeding circuit having a 50 ohm loading impedance;

a first impedance match circuit having a first longitudinal length of a quarter of the one wavelength in the dielectric medium and a 70.7 ohm loading impedance; and a second impedance match circuit having a second longitudinal length of a quarter of the one wavelength in the dielectric medium and a 70.7 ohm loading impedance.

16. The one-dimensional antenna array as claimed in claim 15, wherein the one wavelength in the dielectric medium is calculated by an equation $\lambda_g=\lambda_0/\sqrt{\in_g}$, wherein $\lambda_0$ is the wavelength of electromagnetic wave in vacuum and $\in_g$ is a dielectric constant.

17. A single differential feeding antenna, comprising:

a differential feeding structure having two ports, wherein one port is a feeding point and the other port is connected to a differential circuit having an inverting input and a non-inverting input; and a microstrip antenna stripe having:

two feeding terminals respectively connected to the inverting input and the non-inverting input of the differential circuit; and a longitudinal length which is no longer than a one wavelength in a dielectric medium.

18. The single differential feeding antenna as claimed in claim 17, a widthwise length of the microstrip antenna stripe is substantially equal to a half of the one wavelength in the dielectric medium and a gap between the two feeding terminals of the microstrip antenna stripe is substantially equal to a half of the one wavelength in the dielectric medium.

19. The single differential feeding antenna as claimed in claim 18, wherein the one wavelength in the dielectric medium is calculated by an equation $\lambda_g=\lambda_0/\sqrt{\in_g}$, wherein $\lambda_0$ is the wavelength of electromagnetic wave in vacuum and $\in_g$ is a dielectric constant.

20. The single differential feeding antenna as claimed in claim 17, wherein the one wavelength in the dielectric medium is calculated by an equation $\lambda_g=\lambda_0/\sqrt{\in_g}$, wherein $\lambda_0$ is the wavelength of electromagnetic wave in vacuum and $\in_g$ is a dielectric constant.

* * * * *